United States Patent [19]

Carney et al.

[11] Patent Number: 4,740,168

[45] Date of Patent: Apr. 26, 1988

[54] LOCKING DEVICE FOR TELEPHONE SUBSCRIBER PLUGS

[75] Inventors: William V. Carney, Oyster Bay, N.Y.; Robert Leary, San Ramon, Calif.; Paul V. DeLuca, Plandome Manor, N.Y.

[73] Assignee: Porta Systems Corp., Syosset, N.Y.

[21] Appl. No.: 56,236

[22] Filed: Jun. 1, 1987

[51] Int. Cl.[4] ..... H01R 13/44

[52] U.S. Cl. ..... 439/133; 439/144; 439/147

[58] Field of Search ..... 439/133, 136, 142, 144, 439/147

[56] References Cited

U.S. PATENT DOCUMENTS 3,656,083 4/1972 Brook ..... 439/147
4,311,883 1/1982 Kidney ..... 439/133
4,600,258 7/1986 Hu ..... 439/135
4,605,270 8/1986 Aslizadeh ..... 339/135

*Primary Examiner*—Gil Weidenfeld
*Assistant Examiner*—Paula A. Austin
*Attorney, Agent, or Firm*—Charles E. Temko

[57] ABSTRACT

A device for providing security and environmental protection to an individual telephone subscribed pair having an appearance at a building entrance terminal. The device prevents unauthorized removal of an R.J. 11 plug, and selectively closes the opening leading to a corresponding R.J. 11 jack. In one embodiment, a sliding door is fixed upon a mounting plate and is secured in position by a simple tumbler type lock. In another embodiment, the lock itself includes integrally formed flanges that perform the same function as the sliding plate. In still another embodiment, the plate is substituted by a small padlock hasp.

5 Claims, 1 Drawing Sheet

LOCKING DEVICE FOR TELEPHONE SUBSCRIBER PLUGS

RELATED APPLICATION

Reference is made to copending application Ser. No. 06/022,985 filed Mar. 6, 1987 entitled Locking Device for Telephone Subscriber Plugs, which application is assigned to the same assignee as the instant application, and which discloses and claims a related invention.

BACKGROUND OF THE INVENTION

This invention relates generally to the field of telephony, and more particularly to improved multi-subscriber interface hardware for the purpose of providing security and prevention of environmental contamination.

In a typical installation in a multi-tenant building, a building entrance terminal with twenty-five or one hundred subscriber pairs interconnected thereto is usually mounted upon a building wall, commonly at a basement level. Although a part of the terminal housing is available only to telephone company personnel, of necessity, a second part containing the commonly used R.J. 11 plug is available to the subscribers who connect their equipment, and may remove it for testing.

Such a location lends itself to theft of telephone services, either by unscrupulous tenants who connect their equipment to the lines of other subscribers, or by those who make such interconnection without any legal association with the building. All that is required is the disconnection of a given subscriber equipment plug, and the connection of a telephone handset using a similar plug in an existing jack. It is also desirable to a telephone users to be able to preclude unauthorized persons from having free access to their individual telephone line. Structure for accomplishing this end is most conveniently provided at the location of a standard telephone wall plate outlet or other similar industry standard telephone connection device which contains an R.J. 11 receptacle or similar hardware. It is also desirable that such structure may include such circuitry as a maintenance termination unit or noise suppression and radio filtering circuitry most conveniently accommodated behind the R.J. 11 type jack.

In the above-identified copending application, there is disclosed a device which selectively covers or exposes the opening in an individual subscriber R.J. 11 receptacle by means of a sliding cover plate, together with means for locking the relative position of the plate and the receptacle as desired. The disclosed device includes an alpha-numeric combination locking device which will fix the position of the sliding cover in any of three predetermined relative locations. This construction, while useful, does add to the cost of installation of an individual subscriber circuit which increase cannot always be justified and/or cannot be passed on as a fixed cost to the subscriber.

SUMMARY OF THE INVENTION

Briefly stated, the invention contemplates the provision of a device which mounts upon a plate supporting an R.J. 11 plug receptacle which will accomplish the above-described result at somewhat lower cost to manufacture. In one embodiment a sliding door is fixed upon the mounting plate and is secured in partially closed position by a simple tumbler type lock resembling that previously used in the art for immobilizing a rotary dial on a telephone hand set to prevent the making of unauthorized calls. The cover may be fully opened only by a person in possession of the correct key. This structure permits the user to disable his subscriber pair by simply disconnecting the plug associated with his equipment, and moving the cover to a position to substantially overlie the opening in the receptacle, following which the key operated lock, in the form of a small cylinder is inserted into an adjacent recess in the plate and locked to prevent return movement of the opened position relative to the receptacle. The same structure also serves to maintain the plug in installed condition within the receptacle, so that even if the connecting conductor is cut by an unauthorized person, it is not possible to remove the plug without destroying the device. The device is capable of single as well as multiple mounts. In another embodiment, the lock itself includes integrally formed flanges that perform the same function as the sliding plate, thereby eliminating the need for the plate. In still another embodiment, the plate is substituted by a small padlock hasp.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 3:
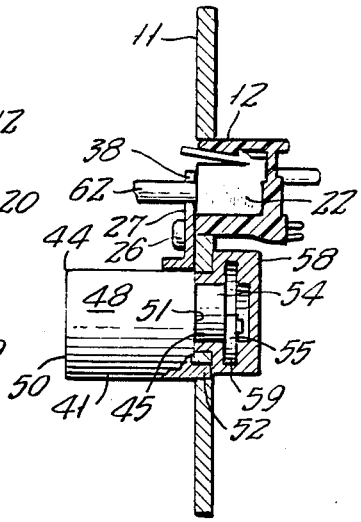
FIG. 3 is a vertical central sectional view, corresponding to that seen in FIG. 2, but showing a subscriber plug in engaged, locked condition.
Figure 4:
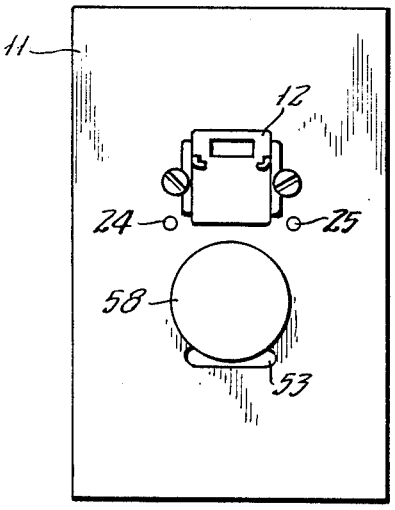
FIG. 4 is a rear elevational view thereof as seen from the left-hand portion of FIG. 3.

In accordance with the invention, the device, generally indicated by reference character 10, includes a mounting plate 11 which may be part of the housing of a building entrance terminal (not shown) of type well known in the art. The plate 11 is adapted to house one or more standard R.J. 11 receptacle jacks, one of which is indicated by reference character 12 in such manner that the receptacle is accessible for insertion of a corresponding subscriber owned plug. The jacks 12 are normally formed of synthetic material, and include a housing 13 positioned in a through opening 14 in the plate 11, the housing being bounded by an upper wall 15, a lower wall 16, side walls 17 and 18, a forward wall 19 and rearward wall 20. The forward wall 19 surrounds a rectangular recess 21 adapted to receive the above-mentioned subscriber owned plug 22 (FIG. 3).

Mounted on a forward surface 23 of the plate 11 are first and second pins 24 and 25, having enlarged terminals 26 on the exposed ends thereof. The pins support a vertically slidable cover 27 through parallel channels 28 and 29 therein. The cover is most conveniently formed as a metallic stamping, or synthetic resinous molding, and is bounded by an inner surface 30, an outer surface 32, a lower edge 33 from which a forwardly extending flange 34 projects, side edges 35 and 36, and an upper edge 37 having a cut out portion 38.

Extending through the plate 11, and positioned below the jack 12 is a circular opening 40, the purpose of which is to accommodate a removable cylindrically shaped telephone dial lock 41 of known type. The lock includes an outer cylindrical sleeve 44 within which is disposed a corresponding cylindrical tumbler 45.

The sleeve 44 is bounded by an outer cylindrical surface 48, an outer end surface 50 and an inner surface 51. An axially extending eccentric shoulder 52 provides means for axially positioning the lock 41 by engaging a slot 53 in the plate 11. The lock 41 includes a solid cylindrical body 54 accommodating the usual locking pins (not shown). The forward surface 50 exposes a conventional keyhole slot (not shown) for the introduction of a corresponding key (not shown). The body 54 supports an eccentric locking member 55 which in locking condition engages a slot 59 in a cap 58 to prevent rotation of the sleeve 44.

Figure 1:
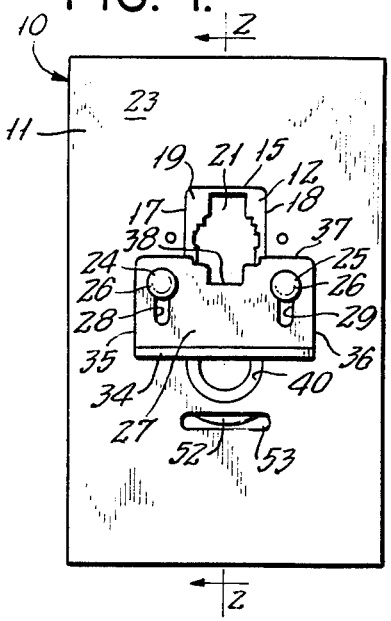
FIG. 1 is a front elevational view of an embodiment of the invention.
Figure 2:
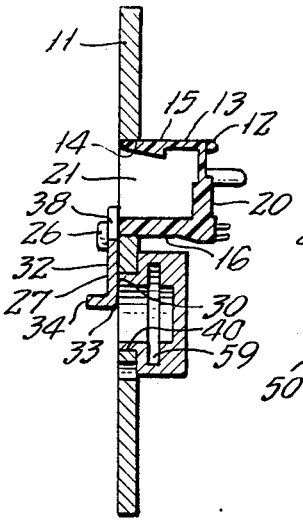
FIG. 2 is a vertical central sectional view thereof, as seen from the plane 2—2 in FIG. 1.

Operation of the device will be apparent from a consideration of the drawing. With the lock 41 in disengaged condition, the cover 27 may be moved to its lowermost position (as seen in FIG. 1) to fully expose the R.J. 11 receptacle 20. In this position, the subscriber may introduce his plug 22 to fully seat the same in normal manner, following which the cover 27 is moved upwardly to the position shown in FIG. 3 to partially overlie the opening in the jack 12, but permit conductors 62 to extend outwardly thereabove. In this condition, the lock 41 is inserted into its corresponding opening, and using a key, the member 52 is rotated to locking condition. They key is then removed, at which point the device assumes the condition shown in FIG. 3. When required, the subscriber may remove the lock, remove his plug, and return the device to locked condition to prevent the unauthorized introduction of another plug.

Figure 5:
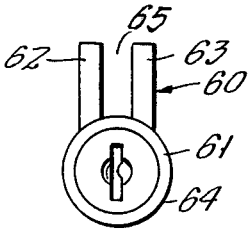
FIG. 5 is a front elevational view of a second embodiment of the invention.
Figure 6:
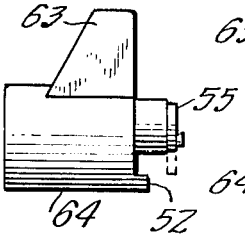
FIG. 6 is a side elevational view thereof.
Figure 7:
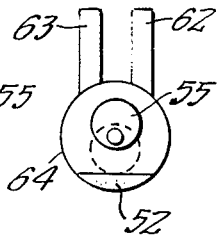
FIG. 7 is a rear elevational view thereof.

FIGS. 5, 6, and 7 illustrates a second embodiment of the invention, generally indicated by reference characters 60.

In this embodiment, the lock 61 includes first and second laterally extending flanges 62 and 63 formed integrally on an outer surface 64. The flanges 62 and 63 are in mutually parallel relation, and define an interstice 65 which overlies the jack (not shown). In the second embodiment, the flanges, in essence, replace the plate 27 of the first embodiment, and provide equivalent structure of greater rigidity, which is not readily tampered with by unauthorized persons.

Figure 8:
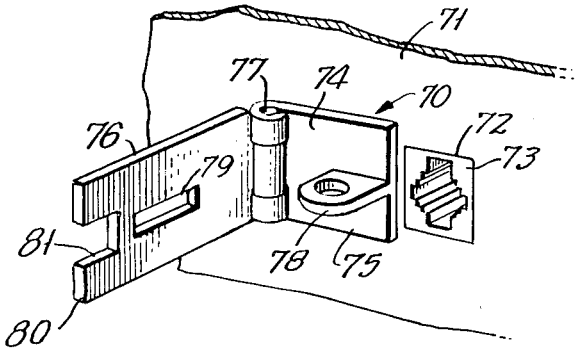
FIG. 8 is a fragmentary view in perspective of a third embodiment of the invention.
Figure 9:
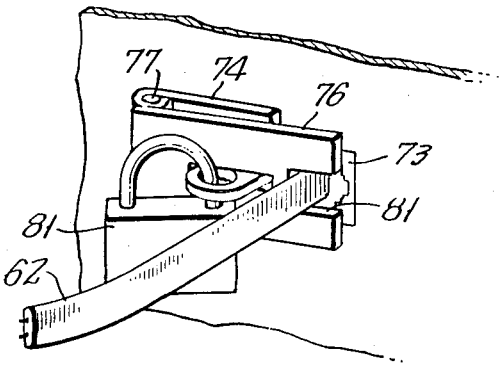
FIG. 9 is a similar view of the third embodiment showing certain of the component parts in altered relative position.

Turning now to FIGS. 8 and 9 in the drawing, a third embodiment of the invention is generally indicated by reference character 70. This embodiment includes a plate 71 having an opening 72 for an R.J. 11 jack 73. The plate 27 of the first embodiment is replaced by a small padlock hasp 74 including a fixed member 75 and a movable member 76 interconnected thereto by hinge members 77. A lock-engaging projection 78 penetrates a slotted opening 79 to permit locking by conventional padlock 82. The free end 80 of the member 76 includes a rectangular slot 81 which overlies the opening 72 when in locked condition.

It will be apparent that other modifications are possible within the spirit of the invention. For example, in the first embodiment, the cover 27 may be engaged in the absence of the pins 24–25, and contoured to prevent rotation about the sleeve 44 of the lock 41. Separate covers may be provided, a larger one of which is supplied to the telephone company and used prior to assignment of the jack 12 to a particular subscriber. This cover is removed by the telephone company, or the subscriber, at the time the smaller cover is installed by the subscriber.

We wish it to be understood that we do not consider the invention to be limited to the precise details of structure shown or suggested in the within specification, for obvious modifications will occur to those skilled in the art to which the invention pertains.

We claim:

1. A locking device for preventing unauthorized access to a telephone subscriber circuit jack located at a building entrance terminal structure or similar interface, said structure defining a recess accommodating a corresponding plug, said locking device comprising: a generally planar plate having inner and outer surfaces and forming a part of said building entrance terminal, said plate defining a generally rectangular opening, said jack being mounted in said opening; a cover member positioned upon said outer surface to at least partially overlie said opening in said jack, said plate having a second opening disposed adjacent said rectangular opening, locking means selectively penetrating said second opening to selectively engage said plate, said locking means simultaneously positioning said cover member to fix the position thereof relative to said opening in said plate, whereby to prevent access to said jack.

2. A locking device in accordance with claim 1, further characterized in said cover member being slidably mounted on said plate.

3. A locking device in accordance with claim 1, further characterized in said cover member being free of direct interconnection with said plate, and being maintained upon said plate by the engagement of said locking means with said plate.

4. A locking device in accordance with claim 1, further characterized in said cover member being formed integrally with said locking means.

5. A locking device in accordance with claim 1, further characterized in said cover member being in the form of a hinged hasp, a first portion of which is secured to said plate, and a second pivotally associated portion of which forms the cover member, said hasp having means for locking the same in closed condition by a padlock.

* * * * *